US005651499A

United States Patent [19]

Mihailoff et al.

[11] Patent Number: 5,651,499

[45] Date of Patent: Jul. 29, 1997

[54] BOLTLESS GUARDRAIL ASSEMBLY FOR A RAILROAD TRACK

[75] Inventors: James P. Mihailoff, Harrisburg, Pa.; Ricky D. Carroll, Erlanger, Ky.

[73] Assignee: Progress Rail Services Corporation, Albertville, Ala.

[21] Appl. No.: 650,174

[22] Filed: May 20, 1996

[51] Int. Cl.[6] ..... E01B 5/18

[52] U.S. Cl. ..... 238/22; 238/20

[58] Field of Search ..... 238/17, 19, 20, 238/21, 22, 23

[56] References Cited

U.S. PATENT DOCUMENTS

| | | | |
|---|---|---|---|
| 795,737 | 7/1905 | Smith | 238/21 |
| 3,026,074 | 3/1962 | Kern | 238/22 |
| 3,063,641 | 11/1962 | Frey | 238/22 |
| 3,292,857 | 12/1966 | Hughes | 238/22 |
| 5,094,387 | 3/1992 | Rice et al. | 238/23 |

OTHER PUBLICATIONS

Drawing of a Seperator Block, one page.

Bethlehem Brochure "Bethlehem SureFit(TM) Boltless Adjustable Brace", one page.

Pandrol Clip & Shoulder Brochure "e" Series Clip, four pages.

*Primary Examiner*—S. Joseph Morano

*Attorney, Agent, or Firm*—James E. Bradley

[57] ABSTRACT

A railroad track is provided having a running rail and a guardrail which are spaced apart by self-locking separator blocks and mounted to base plates. The foot of the running rail fits within channels formed into each of the base plates, with an outward end of the foot secured within the channels by toe plates and an inward end of the foot secured within the channels by inward quick release fasteners. The guardrail is mounted atop the toe plates, outward from the running rail. Side brace plates and outward quick release fasteners are used to hold the guardrail against the separator blocks and on top of the toe plates. Vertical holes are formed into the foot of the guardrail, inward of the guardrail web and in the toe plate. The separator blocks each have a block extension which protrudes downward from the separator blocks through a respective one of the vertical holes in the guardrail foot and into one of the holes in the toe plate. The inward end of the separator blocks fit flush against the web of the running rail and directly underneath the running rail head. An outward end of the separator blocks fit flush against at least part of the web of the guardrail and along the top of the inward side of the foot of the guardrail. The separator blocks are secured between the guardrail and the running rail by the block extensions and web fit between the guardrail and the running rail.

20 Claims, 2 Drawing Sheets

BOLTLESS GUARDRAIL ASSEMBLY FOR A RAILROAD TRACK

BACKGROUND OF THE INVENTION

1. Field of the Invention

This invention relates to a guardrail assembly for railroad tracks for preventing train wheels from disengaging from the railroad tracks.

2. Description of the Prior Art

Guardrails have been provided for placing outside of railroad tracks to prevent train wheels from disengaging from the running rails of the railroad tracks. Guardrails are typically installed at railroad switching stations, such as are commonly found in rail yards. The guardrails are typically of similar construction to the running rails. Both the running rails and guardrails have been mounted to base plates, with the guardrails disposed outside of the running rails. A gap is left between the guardrails and running rails through which train wheels may pass. Separator blocks are placed between the guardrails and running rails to space the guardrails apart from the running rails to provide clearance for the train wheels to pass through.

Guardrails and running rails have typically been welded to the base plates. However, welding guardrails and running rails to base plates makes removal and replacement of worn guardrails and running rails a very time consuming task.

Separator blocks have been provided with holes extending all the way through the separator blocks for passing bolts. Holes are also drilled through the webs of the running rails and the guardrails for bolting the separator blocks between the guardrails and the running rails. However, drilling holes through the webs of guardrails and running rails can threaten their structural integrity. Railroad operators prefer to not have holes drilled through running rails. Additionally, when separator blocks are bolted between guardrails and running rails the nuts on bolts fastening the separator blocks tend to loosen due to vibration from trains running over the rails and knocking against the guardrails.

SUMMARY OF THE INVENTION

A railroad track is provided having a running rail and a guardrail which are spaced apart by self-locking separator blocks and mounted to base plates. The foot of the running rail fits within channels formed into each of the base plates, with an outward end of the foot secured within the channels by toe plates and an inward end of the foot secured within the channels by inward quick release fasteners. The guardrail is mounted atop the toe plates, outward from the running rail. Side brace plates and outward quick release fasteners are used to hold the guardrail against the separator blocks and on top of the toe plates. Vertical holes are formed into the foot of the guardrail, inward of the guardrail web. The separator blocks each have a finger or extension which extends downward from the separator blocks and into a respective one of the vertical holes in the guardrail foot. The inward end of the separator blocks fit flush against the web of the running rail and directly underneath the running rail head. An outward end of the separator blocks fit flush against at least part of the web of the guardrail and along the top of the inward side of the foot of the guardrail. The separator blocks are secured between the guardrail and the running rail by the block extensions and web fit between the guardrail and the running rail.

BRIEF DESCRIPTION OF THE DRAWINGS

The novel features believed characteristic of the invention are set forth in the appended claims. The invention itself however, as well as a preferred mode of use, further objects and advantages thereof, will best be understood by reference to the following detailed description of an illustrative embodiment when read in conjunction with the accompanying drawings, wherein:

DETAILED DESCRIPTION OF THE PREFERRED EMBODIMENT

Figures 1, 3:
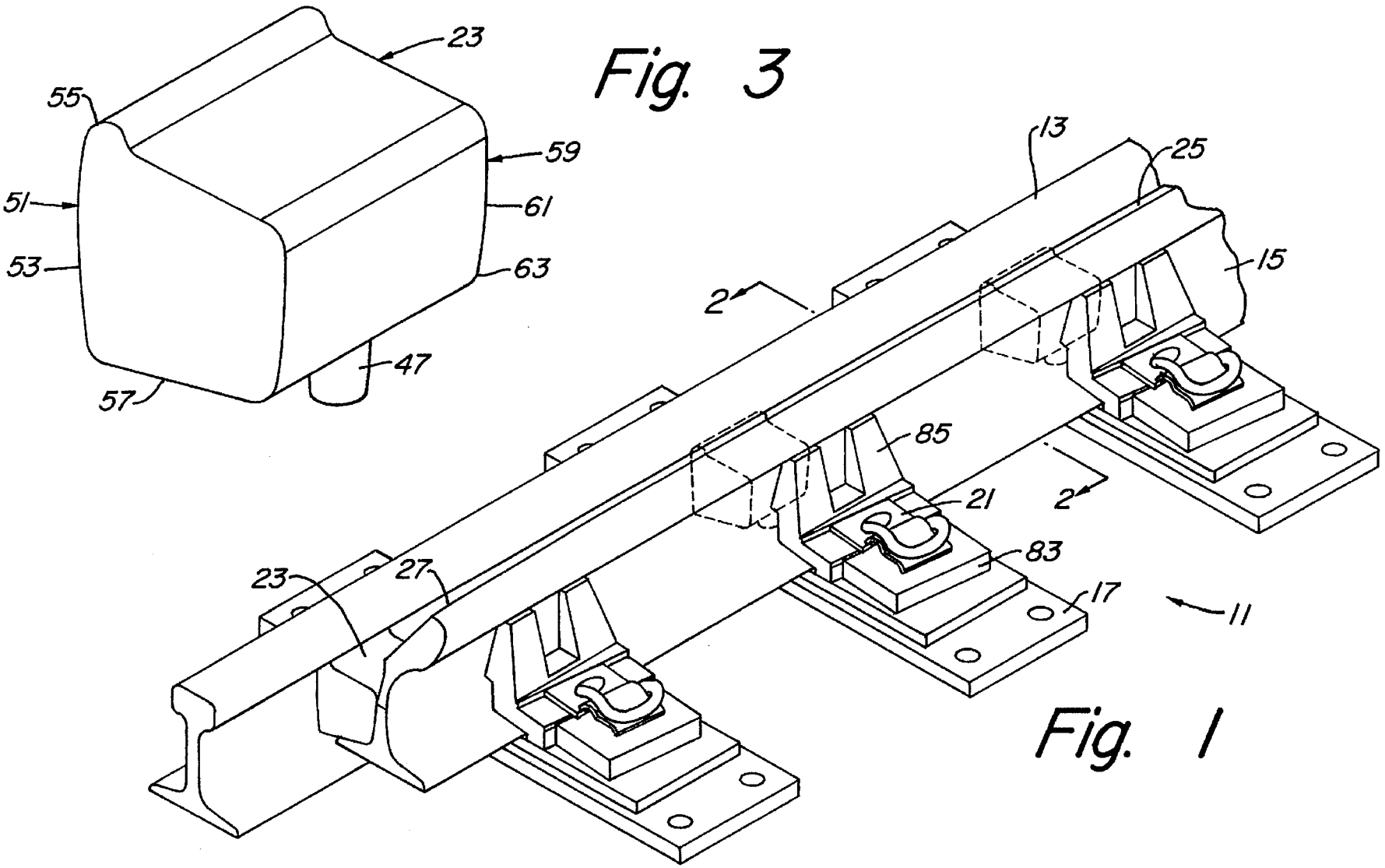
FIG. 1 is a perspective view of a railroad track made according to the present invention, with a guardrail disposed outward from a running rail for preventing a train wheel from disengaging from the running rail.
FIG. 3 is a perspective view of a self-locking separator block of FIG. 2.

FIG. 1 is a perspective view of one side of railroad track 11 of the present invention. Railroad track 11 includes running rail 13 and guardrail 15 which are mounted to base plates 17. Guardrail 15 is disposed outward from running rail 13. Running rail quick release fasteners 19 (shown in FIG. 2) and guardrail quick release fasteners 21 secure running rail 13 and guardrail 15 to base plates 17. Separator blocks 23 are spaced apart between running rail 13 and guardrail 15 to provide gap 25 between rails 13, 15. Guardrail 15 has tapered end section 27 for guiding a train wheel into gap 25 between running rail 13 and guard rail 15.

Figure 2:
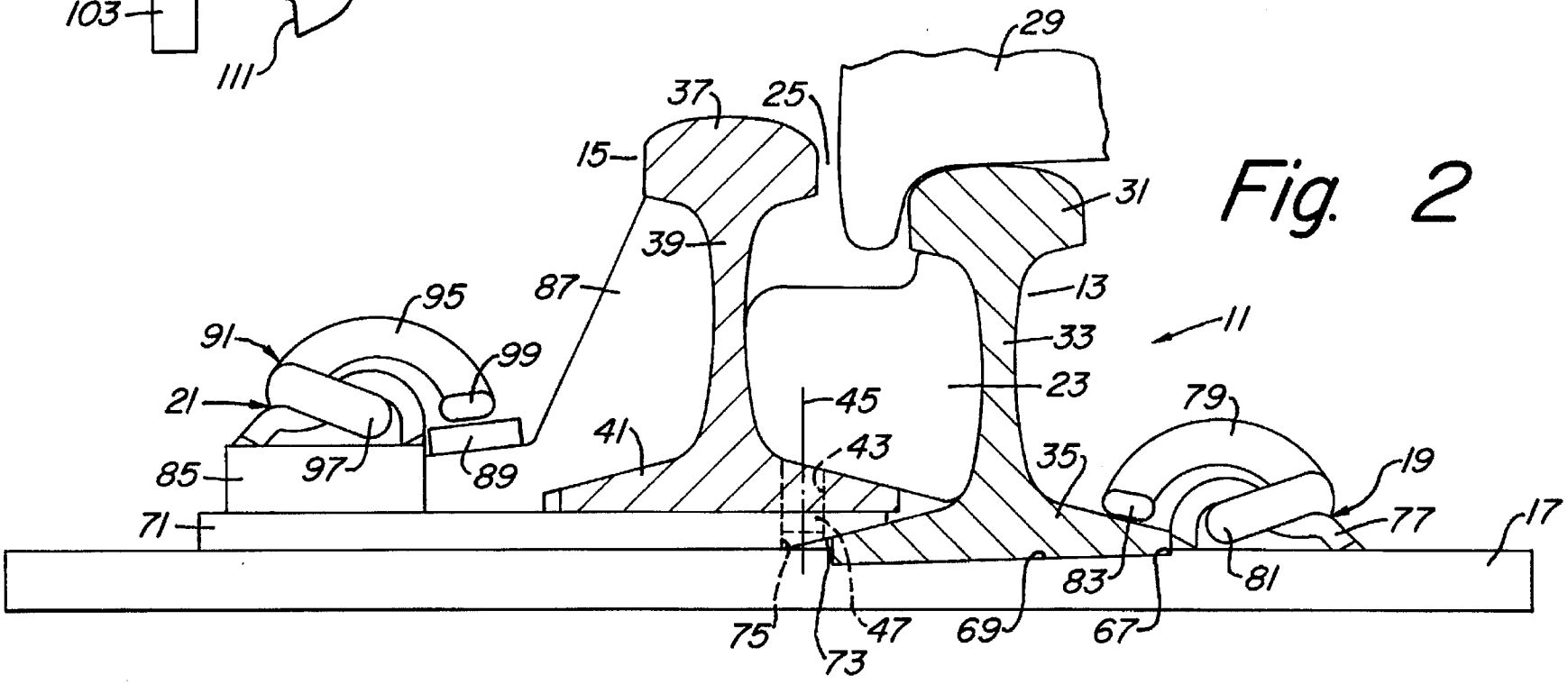
FIG. 2 is a sectional view of the railroad track of FIG. 1, taken along section line 2—2 of FIG. 1.

FIG. 2 is a cross-sectional view of the section of railroad track 11 depicted in FIG. 1, taken along section line 2—2. Train wheel 29 is running atop railroad track 11 engaging running rail head 31. Train wheel 29 extends into gap 25 between running rail 13 and guard 15. Running rail 13 includes running rail head 31, running rail web 33 and running rail foot 35. Fillets extend in the surface portions of running rail 13 between running rail web 33 and running rail head 31, and between running rail web 33 and running rail foot 35. Guardrail 15 includes guardrail head 37, guardrail web 39 and guardrail foot 41. Fillets extend on the surfaces of guardrail 15 between guardrail web 39 and guardrail head 37, and between guardrail web 39 and guardrail foot 41. Vertical holes 43 (one shown) are drilled through a portion of guardrail foot 41, inward from guardrail web 39 with respect to railroad track 11 and spaced apart along guard rail foot at each of base plates 17. Holes 43 have vertical central axes 45, which are preferably center lines for round holes 43.

FIG. 3 is a perspective view of one of separator blocks 23. Block extension 47 is integrally casts as a part of and extends downward from separator block 23. Block extension 47 is in the shape of a cylindrical pin. Separator block 23 has an inner end 51 with end surface 53 for fitting flush with running rail web 33 (shown in FIG. 2). Separator block also has an upper surface 55 which is curved and fits flush against and underneath running rail head 31 (shown in FIG. 2). Lower surface 57 of separator block 23 is provided for fitting flush against the inward end of guardrail foot 41 (shown in FIG. 2). Outer end 59 of separator block 23 defines an outward surface having an upper portion 61 for fitting flush against at least a portion of guardrail web 39, and lower portion 63 for fitting flush against the fillet between the inner side of guardrail web 39 and the top of an inward portion of guardrail foot 41. Lower portion 63 has a curved shape so that it is contoured to provide separator block 23 with a profile for fitting flush against the inward profile of guardrail foot 41 and guardrail web 39.

FIG. 2 depicts one of channels 67 for receiving running rail foot 35. Each of channels 67 have a seat surface 69 which is canted to slope downward in an outward direction, that is, in a direction towards guardrail 15. The bottom of running rail foot 35 fits flush against seat surfaces 69 so that the longitudinal center line of running railhead 31 is canted slightly outward from the longitudinal center line of running rail foot 35.

An outward end of foot 35 of running rail 13 is held within channel 67 by toe plates 71 (one shown in FIG. 2). Toe plates 71 each have inward end 73 having a bevelled lower surface for fitting flush against a portion of the outward, upper surface of running rail foot 35. Toe plates 71 each have one vertical hole 75 which locates directly beneath one of holes 43 in guardrail foot 41 for receiving the lower end of one of the block extensions 47 of separator blocks 23. Toe plate 71 is preferably welded to base plate 17.

Running rail quick release fasteners 19 secure the inward side of running rail foot 35 to base plates 17. One of running rail shoulder plates 77 are welded to each of base plates 17, aside of and immediately adjacent to channels 67. Quick release fasteners 19 further include inward spring clips 79 which each have a first portion 81 for engaging beneath one of running rail shoulder plates 77 and a toe portion 83 for engaging atop the inward portion of running rail foot 35.

Referring to FIGS. 1 and 2, guardrail quick release fasteners 21 include stop blocks 85 which are welded atop toe plates 71. Side brace plates 87 are formed for placing adjacent to and inward of stop blocks 85, and extending along the inward side guardrail 15. Stop blocks 85 may have a serrated outward, upward facing surfaces for engaging locking members 89. Locking members 89 preferably have lower serrated surfaces.

Guardrail quick release fasteners include fastener assemblies 91 for securing side braceplates 87 against guardrail 15. Fastener assemblies 91 include guardrail shoulder plates 93 which are preferably welded to stop blocks 85. Outward spring clips 95 each have a first portion 97 for extending beneath one of guardrail shoulder plates 93, and toe portion 99 which is driven above one of looking members 89 and presses downward on locking members 89 to secure stop blocks 85 to toe plates 71.

The method for assembling railroad track 11 of the present invention is now described. Several base plates 17 are provided with channels 67 formed therein and running rail shoulder plates 77 welded to upper surfaces of base plates 17, spaced inward and immediately adjacent to channels 67. Toe plates 71 are welded to base plates 17 and stop blocks 85 are welded on top of toe plates 71. Guardrail shoulder plates 93 are welded on top of stop blocks 85. Each of base plates 17 are preferably provided with one running rail shoulder plate 77, one toe plate 71, one stop block 85 and one guardrail shoulder plate 93.

Base plates 17 are spaced apart and running rail 13 is then placed on top of each of base plates 17, with the lower end of running rail foot 35 fitting flush against seat surfaces 69 in channels 67 and the outward end of running rail foot 35 fitting underneath toe plates 71. Running rail 13 is then secured to each of base plates 17 by placing first portion 81 of inward spring clips 79 underneath running rail shoulder plates 77 and then hammering inward spring clips 79 until toe portions 83 are above and immediately atop the inward end of running rail foot 35, at each of base plates 17.

Guardrail 15 is placed on top of toe plates 17, spaced apart from running rail 13 so that separator blocks 23 may be passed through gap 25. Separator blocks 23 are then placed on top of the inward side of guardrail foot 41, spaced apart along the lengths of running rail 13 and guardrail 15. The block extensions 47 of each of the separator blocks 23 are placed into respective ones of holes 43 in guardrail foot 41. Then, guardrail 15 is moved inward toward running rail 13 until inward ends 51 of separator blocks 23 engage flush against the outward side of running rail web 33 and the lower surface of running rail head 31. When separator blocks 23 are pressing flush between running rail web 33 and guardrail web 39, holes 43 in guardrail foot 41 will be aligned directly above hole 75 in toe plate 71. Block extensions 47 of separator blocks 23 will then fall downward from holes 43 and into holes 75 in toe plates 71. In some embodiments, holes 75 in toe plates 75 may be large enough to receive block extensions 47 prior to pressing separator blocks 23 flush between running rail web 33 and guard rail web 39. Outer ends 59 of separator blocks 23 fit flush against at least a portion of the inward side of guardrail web 39 and flush against the top of the inward portion of guardrail foot 41.

Side brace plates 87 are then placed between stop blocks 85 and the outward end of guardrail foot 41, and adjacent to guardrail web 39 and underneath guardrail head 37. Locking members 89 are placed atop the outward side of side brace plates 87. The first portions 97 of outward spring clips 95 are then placed underneath guardrail shoulder plates 93. Toe portions 99 of outward spring clips 95 are then driven, by hammering spring clip 95 onto locking members 89 to secure side brace plates 87 in position holding guardrail 15 firmly against separator blocks 23 and running rail 13. This secures running rail 13 and guardrail 15 rigidly together and to base plate 17. Separator blocks 23 are self-locked by fitting flush between running rail 13 and guardrail 15, with block extensions 47 extending into holes 43, 74.

A train track 11 of the present invention is disassembled to replace guardrail 13 and/or running rail 15 by reversing the above procedure. Toe portions 99 of outward spring clips 95 are driven from above locking members 89 to free side brace plates 87 for removal. Side brace plates 87 are then removed to free guard rail 13. Guardrail 13 is then moved outward across toe plates 71 and block extensions 47 of separator blocks 23 are removed from holes 43, 75. Running rail 13 is released from base plate 17 by first driving toe portions 83 of inward spring clips 79 from above the inward end of running rail foot 35. Running rail 13 may then be removed from channels 67 in base plates 17.

When train wheel 29 is engaged with running rail 13, often, especially along curves in switching yards, the train wheel 29 will move outward and bump against guardrail head 37. In a train track made in accordance with the present invention, wheel 29 bumping against guardrail head 37 will cause guardrail head 37 to rotate outward, above guardrail foot 41. However, with separator blocks 23 of the present invention, when guardrail head 37 tries to move in an outward direction, the inward side of guardrail foot 41 will tend to move upwards and push separator blocks 23 against the outward, lower portion of running rail head 31. This causes the outward force of train wheel 29 bumping against guardrail head 37 to be transferred into an upward force of separator blocks 23 pushing upwards against running rail head 31. The weight of the train pressing downward on train wheel 29 will press against running rail head 31 and oppose the upward force. The downward weight of the train will be transferred from train wheel 29 onto running rail head 31 and against the inward end of separator blocks 23. Separator blocks 23 will transfer a downward force onto the inward side of guardrail foot 41 and prevent guardrail head 37 from rotating outward from running rail head 31.

Figure 4:
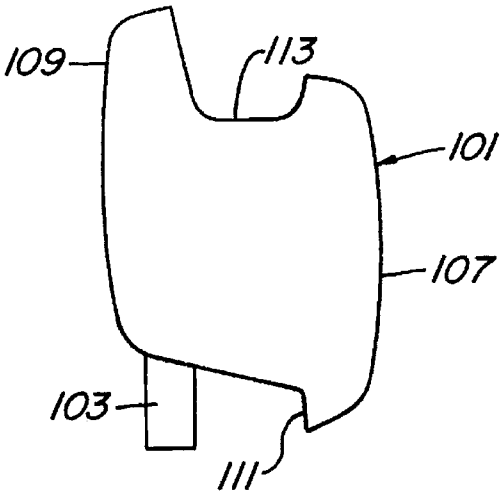
FIG. 4 is a side view of an alternative embodiment of a self-locking separator block made according to the present invention.

FIG. 4 depicts a separator block 101 of an alternative embodiment of the present invention. Block extension 103 protrudes downward from separator block 101. Inward surface 107 will fit flush against a running rail of a train track according to the present invention. Inward surface 107 will fit flush within the fillet between a running rail head and a running rail web, and will extend beneath the running rail head. Outward surface 109 fits flush against a guardrail web and underneath a guardrail head, fitting flush against the fillet between the guardrail web and the guardrail head. Lower surface 111 is provided for fitting flush against the inward upper surface of a guardrail foot, much as separator block 23 of FIG. 2. Lower surface 111 will intersect inward surface 107, providing a tabbed section which fits flush against the innermost vertical end surface of a guardrail foot, filling the space between the innermost end surface of the guardrail foot and the outward foot of a running rail. Alternative separator block 101 further includes a channelled section 113 to provide clearance with a train wheel.

The present invention provides several advantages over prior art railroad tracks having guardrails. A separator block made according to the present invention will not require holes to be drilled through the webs of running rails and guard rails for passing bolts. The separator block of the present invention is self-locking. Further, quick release means are provided so that a worn guardrail and running rail may be quickly removed and replaced without requiring removal of either bolts or grinding of welds. The structural integrity of running rails and guardrails assembled according to the present invention will not be threatened by having to drill holes through the webs of the running rails and the guardrails.

Additionally, when a train wheel bumps against the head of a guardrail of a train track made according to the present invention the outward lateral force of the train wheel bumping against the guardrail head is opposed by the weight of the train pressing downward on the wheel. The weight of the train is passed through the bottom of the running rail head, against the separator block and downward onto the inward side of the foot of the guardrail.

While the invention has been shown in only one of its forms, it should be apparent to those skilled in the art that it is not so limited, but is susceptible to various changes without departing from the scope of the invention.

We claim:

1. In a railroad track of the type having a running rail and a guardrail disposed outward of the running rail for preventing a train wheel from disengaging from the running rail, the running rail having a running rail head, a running rail foot and a running rail web connecting between the running rail head and the running rail foot, with running rail fillets extending from the running rail web to the running rail head and running rail foot, the guardrail having a guardrail head, a guardrail foot and a guardrail web extending between the guardrail head and the guardrail foot, with guardrail fillets extending from the guardrail web to the guardrail head and guardrail foot, a base plate extending beneath the running rail and the guardrail, running rail mounting means for securing the running rail to the base plate, and guardrail mounting means for securing the guardrail to the base plate, the improvement comprising:

the guardrail foot having a hole formed therein, inward of the guardrail web, the hole having a substantially vertical central axis;

a separator block extending between the guardrail and the running rail, spacing apart the guardrail and the running rail; and a block extension protruding downward from the separator block and into the hole in the guardrail foot.

2. The railroad track according to claim 1, wherein the block extension of the separator block is a cylindrical pin.

3. The railroad track according to claim 1, further comprising:

a toe plate secured to and overlying the base plate, extending beneath the guardrail and having a lower surface which overlies an outward portion of the running rail foot, the toe plate having a hole which registers with the hole in the guardrail foot; and wherein the block extension of the separator block extends downward through the hole in the guardrail foot and into the hole in the toe plate.

4. The railroad track according to claim 1, wherein an inner portion of the guardrail foot extends above an outward end of the running rail foot.

5. The railroad track according to claim 1, further comprising:

a toe plate secured to and overlying the base plate, extending beneath the guardrail and having a lower surface which overlies an outward portion of the running rail foot, the toe plate having a hole which registers with the hole in the guardrail foot; wherein the block extension of the separator block extends downward through the hole in the guardrail foot and into the hole in the toe plate; and an inner portion of the guardrail foot extends directly above an outward end of the running rail foot.

6. The railroad track according to claim 1, wherein:

the separator block includes an inward surface which engages the running rail web and engages against and underneath an outward portion of the running rail head; and the separator block further includes an outward surface which fits flush against an inward side of the guardrail web and an upper surface of an inward portion of the guardrail foot, the outward surface of the separator block extending outward across the upper surface of the guardrail foot substantially beyond the one of the fillets which extends between the inward side of the guardrail web and the upper surface of the inward portion of the guardrail foot.

7. A railroad track of the type having a running rail and an outwardly mounted guardrail to prevent a train wheel from disengaging from the running rail, the railroad track comprising:

a running rail having a running rail head, a running rail foot and a running rail web connecting between the running rail head and the running rail foot, with running rail fillets extending from the running rail web to the running rail head and running rail foot;

the guardrail disposed outward of the running rail, the guardrail having a guardrail head, a guardrail foot and a guardrail web extending between the guardrail head and the guardrail foot, with guardrail fillets extending from the guardrail web to the guardrail head and guardrail foot, and the guardrail having a hole formed therein;

a base plate extending beneath the running rail and the guardrail, the base plate having a channel formed therein for receiving the running rail foot;

running rail quick release fastener means for securing an inward portion of the running rail foot to the base plate;

side brace means for fitting against an outward side of the guardrail and retaining the guardrail against moving in an outward direction;

guardrail quick release fastener means for securing an outward side of the side brace means to the base plate;

a separator block extending between the guardrail and the running rail, spacing apart the guardrail and the running rail, and having a block extension which extends into the hole in the guardrail;

the separator block having an inward upper surface which engages against and underneath an outward portion of the running rail head;

the separator block further having an outward surface which fits flush against an inward side of the guardrail web and an upper surface of an inward portion of the guardrail foot, the outward surface of the separator block extending outward across the upper surface of the guardrail foot substantially beyond the one of the fillets which extends between the inward side of the guardrail web and the upper surface of the inward portion of the guardrail foot; and toe plate means for locking in the separator block and retaining an outward portion of the running rail within the channel formed in the base plate.

8. The railroad track of claim 7, wherein:

the hole in the guardrail has a central axis which extends substantially vertical and into the guardrail foot, inward of the guardrail web; and the block extension of the separator block extends downward from the separator block and into the hole in the guardrail.

9. The railroad track according to claim 7, wherein the toe plate means comprises a toe plate which has a hole and is located beneath the guardrail, and the block extension of the separator block extends through the hole in the guardrail and into the hole in the toe plate.

10. The railroad track according to claim 7, wherein the toe plate means comprises a toe plate which is secured to a base, extends beneath the guardrail and has a lower surface which overlies an outward portion of the running rail foot, the toe plate having a hole which registers with the hole in the guardrail; and wherein the block extension of the separator block extends downward through the hole in the guardrail and into the hole in the toe plate.

11. The railroad track according to claim 7, wherein the inward portion of the guardrail foot extends above an outward portion of the running rail foot.

12. The railroad track according to claim 7, wherein the toe plate means comprises a toe plate which is secured to a base, extends beneath the guardrail and has a lower surface which overlies an outward portion of the running rail foot, the toe plate having a hole which registers with the hole in the guardrail; wherein the block extension of the separator block extends downward through the hole in the guardrail and into the hole in the toe plate; and the inward portion of the guardrail foot extends above the outward portion of the running rail foot.

13. The railroad track according to claim 7, wherein the channel of the running rail foot further includes a seat surface for receiving a lowermost end of the running rail, with the seat surface being canted to slope downward towards an outer direction.

14. The railroad track according to claim 7, wherein the toe plate means comprises a toe plate which is a separate member from the guardrail foot, having an inward end lower surface formed for fitting flush against an outward portion of the running rail foot for locking the separator block between the guardrail and the running rail.

15. The railroad track according to claim 7, wherein:

the hole in the guardrail has a central axis which extends substantially vertical and into the guardrail foot, inward of the guardrail web;

the block extension of the separator block extends downward from the separator block and into the hole in the guardrail foot;

the inward portion of the guardrail foot extend above an outward portion of the running rail foot; and the channel of the running rail foot further includes a seat surface for receiving a lowermost end of the running rail, with the seat surface being canted to slope downward towards an outer direction.

16. A railroad track of the type having a running rail and an outwardly mounted guardrail to prevent a train wheel from disengaging from the running rail, the railroad track comprising:

a running rail having a running rail head, a running rail foot and a running rail web connecting between the running rail head and the running rail foot, with running rail fillets extending from the running rail web to the running rail head and running rail foot;

a guardrail disposed outward of the running rail, the guardrail having a guardrail head, a guardrail foot and a guardrail web extending between the guardrail head and the guardrail foot, with guardrail fillets extending from the guardrail web to the guardrail head and guardrail foot;

a base plate extending transversely to the running rail and the guardrail, the base plate having a rail pocket formed therein to define a canted seat surface for receiving the lowermost end of the running rail foot;

a toe plate mounted to the base plate to extend beneath the guardrail and outward from the rail pocket, the toe plate having a lower surface for extending above an outward side of the running rail foot when the running rail is disposed within the rail pocket of the base plate;

a running rail shoulder plate mounted to the base plate, inward of and adjacent to the running rail foot;

an inward spring clip fastener having an inward clip first portion for engaging the running rail shoulder plate, and an inward clip toe portion for engaging an upper side of an inward end of the running rail foot to secure the running rail to the base plate with the running rail disposed within the rail pocket of the base plate and the outward end of the running rail foot extending beneath the toe plate;

a stop block mounted to the toe plate, outward of and spaced apart from the guardrail;

a side brace extending between the stop block and the guardrail, outward of the guardrail web, between the guardrail head and the guardrail foot, for bracing the guardrail from moving outward from the running rail;

a guardrail shoulder plate mounted atop the toe plate, outward of and adjacent to the side brace;

a locking member extending adjacent to and inward of the guardrail shoulder plate, and above an outward end of the side brace, the locking member having a serrated lower surface, with the serrated lower surface engaging the outward end of the side brace;

an outward spring clip fastener having an outward clip first portion for engaging the guardrail shoulder plate, and an outward clip toe portion for engaging the upper surface of the locking member to secure the side brace between the stop plate and the guardrail and latch the guardrail to the toe plate;

the guardrail foot having a hole formed therethrough with a centerline axis which extends in a substantially vertical direction, inward of the guardrail web;

the toe plate having a hole therein which registers with the hole in the guardrail foot; and a separator block extending between the guardrail and the running rail, spacing apart the guardrail and the running rail, and having a block extension which protrudes downward from the separator block through the hole in the guardrail foot and into the hole in the toe plate.

17. The railroad track according to claim 16, wherein the block extension of the separator block is a cylindrical pin.

18. A method for mounting a running rail and guardrail into a railroad track comprising the steps of:

providing a running rail, a guardrail, a base plate, a running rail mounting assembly, a guardrail mounting assembly and a plurality of separator blocks, each of the separator blocks having a block extension protruding downward from the separator blocks;

securing the running rail to the base plate with the running rail mounting assembly;

drilling spaced apart vertical holes into a foot of the guardrail, the holes extending outward of a web of the guardrail;

placing the guardrail outward of the running rail, spaced apart from the running rail, and the separator blocks between the guardrail and the running rail with the block extensions of the separator blocks extending downward into the holes in the foot of the guardrail;

securing the guardrail to the base plate with the guardrail mounting assembly, with the separator blocks fitting flush against an upper side of the foot of the guardrail, fitting flush against part of the web of the guardrail, fitting flush against and underneath a head of the running rail, and fitting flush against at least a portion of a running rail web of the running rail; and wherein the separator blocks are locked into positions between the guardrail and the running rail by the block extensions extending downward into the holes in the foot of the guardrail and the separator blocks fitting flush against the running rail and guardrail.

19. The method according to claim 18, further comprising mounting a toe plate to the base plate beneath the guardrail, with a lower surface of the toe plate extending above an outward side of the running rail foot;

providing the toe plate with a hole which registers with the hole in the running rail foot; and passing the block extension through the hole in the running rail foot and into the hole in the toe plate.

20. The method according to claim 18, wherein the step of placing the guardrail outward of the running rail, spaced apart from the running rail, comprises placing an inward end portion of the foot of the guardrail above an outward end portion of a running rail foot.

* * * * *